US010957243B1

(12) United States Patent
Liu et al.

(10) Patent No.: US 10,957,243 B1
(45) Date of Patent: Mar. 23, 2021

(54) DISPLAY DRIVE CIRCUIT, METHOD FOR OPERATING SAME, AND DISPLAY PANEL

(71) Applicant: TCL China Star Optoelectronics Technology Co., Ltd., Guangdong (CN)

(72) Inventors: Quansheng Liu, Guangdong (CN); Yongliang Huang, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/620,475

(22) PCT Filed: Nov. 27, 2019

(86) PCT No.: PCT/CN2019/121217

§ 371 (c)(1),
(2) Date: Dec. 6, 2019

(30) Foreign Application Priority Data

Nov. 13, 2019 (CN) ..... 201911104630.2

(51) Int. Cl.
*G09G 3/3208* (2016.01)
*G09G 3/32* (2016.01)

(52) U.S. Cl.
CPC ..... *G09G 3/32* (2013.01); *G09G 2300/0426* (2013.01); *G09G 2300/08* (2013.01); *G09G 2310/0202* (2013.01); *G09G 2310/0264* (2013.01); *G09G 2320/043* (2013.01); *G09G 2330/021* (2013.01)

(58) Field of Classification Search
CPC ..... G09G 3/30–3291
See application file for complete search history.

(56) References Cited

U.S. PATENT DOCUMENTS

| | | | | |
|---|---|---|---|---|
| 2009/0140959 | A1 | 6/2009 | Nam | |
| 2015/0179105 | A1 | 6/2015 | Mizukoshi | |
| 2017/0004764 | A1* | 1/2017 | Kim | G09G 3/3233 |
| 2019/0035813 | A1* | 1/2019 | Huang | H01L 27/124 |
| 2019/0114962 | A1* | 4/2019 | Jang | G09G 3/3233 |
| 2020/0327845 | A1 | 10/2020 | Nathan et al. | |

FOREIGN PATENT DOCUMENTS

| | | | |
|---|---|---|---|
| CN | 101116129 | A | 1/2008 |
| CN | 101430862 | A | 5/2009 |
| CN | 103021336 | A | 4/2013 |
| CN | 104732920 | A | 6/2015 |
| CN | 110223637 | A | 9/2019 |
| KR | 20170046198 | A | 5/2017 |

* cited by examiner

*Primary Examiner* — Roy P Rabindranath

(57) ABSTRACT

A display drive circuit, a method for operating the display drive circuit, and a display panel. The method for operating the display drive circuit comprises: reversing output values of a first voltage output terminal and a second voltage output terminal to make a reference voltage output terminal outputs a high voltage, and a sampling voltage output terminal outputs a low voltage; scan lines providing a scan voltage, data lines providing a data voltage, and a sensor sensing a voltage variation value of a anode of a light-emitting diode; and adjusting the data voltage provided by the data lines according to the voltage variation value.

3 Claims, 2 Drawing Sheets

DISPLAY DRIVE CIRCUIT, METHOD FOR OPERATING SAME, AND DISPLAY PANEL

FIELD OF INVENTION

The present disclosure relates to the field of display technologies, and more particularly to a display drive circuit, a method for operating the display drive circuit, and a display panel.

BACKGROUND OF INVENTION

With development of technology, requirements for quality of display panels are getting higher. In current display panels, a drive circuit for light-emitting diodes (LEDs) is usually a structure of 2T1C, which is a circuit structure having two thin film transistors (TFTs) and one capacitor.

Technical Problem

When TFTs work for a long time, voltage drift will occur, thereby causing display panels to display poorly and affecting use of users.

SUMMARY OF INVENTION

The present disclosure provides a display drive circuit and a display panel to solve the technical problem, thereby ensuring display quality, extending product life, and avoiding waste of resources.

To solve the above technical problem, an embodiment of the present disclosure is to provide a display drive circuit which comprises: a plurality of data lines and scan lines disposed perpendicular to and insulated from each other, wherein the data lines are used to provide a data voltage, and the scan lines are used to provide a scan voltage; a first thin film transistor, wherein a gate electrode of the first thin film transistor is connected to the data lines, and a first electrode of the first thin film transistor is connected to the scan lines; a second thin film transistor, wherein a gate electrode of the second thin film transistor is connected to a second electrode of the first thin film transistor, a first electrode of the second thin film transistor is connected to a first voltage output terminal, and a second electrode of the second thin film transistor is connected to a second voltage output terminal; a third thin film transistor, wherein a gate electrode of the third thin film transistor is connected to a sampling voltage output terminal, a first electrode of the third thin film transistor is connected to the second electrode of the second thin film transistor, and a second electrode of the third thin film transistor is connected to a reference voltage output terminal; a light-emitting diode, wherein an anode is connected to the second electrode of the second thin film transistor, and a cathode is connected to the second voltage output terminal; and a sensor connected to the second electrode of the third thin film transistor.

Wherein the display drive circuit further comprises: a capacitor, wherein a first terminal of the capacitor is connected to the first voltage output terminal, and a second terminal of the capacitor is connected to the gate electrode of the second thin film transistor.

Wherein both the first voltage output terminal and the second voltage output terminal can output a high voltage and a low voltage with fixed amplitudes.

Wherein the display drive circuit further comprises: a control chip used to control the amplitudes of the voltages output from the first voltage output terminal and the second voltage output terminal.

Wherein the control chip is connected to the sensor and the data lines, and used to adjust a voltage value of the data voltage provided by the data lines according to the sensor.

Wherein one of the first voltage output terminal and the second voltage output terminal outputs the high voltage, and the other outputs the low voltage.

To solve the above technical problem, an embodiment of the present disclosure further provides a method for operating the above display drive circuit. The method comprises: inverting output values of the first voltage output terminal and the second voltage output terminal to make the reference voltage output terminal outputs a high voltage, and the sampling voltage output terminal outputs a low voltage; the scan lines providing the scan voltage, the data lines providing the data voltage, and the sensor sensing a voltage variation value of the anode of the light-emitting diode; and adjusting the data voltage provided by the data lines according to the voltage variation value.

Wherein the step of adjusting the data voltage provided by the data lines according to the voltage variation value comprises: obtaining an end value of the voltage variation value and calculating a drift voltage of the second thin film transistor; and adding the drift voltage to the data voltage provided by the data lines to be a new data voltage.

Wherein an initial value of the first voltage output terminal is the low voltage, an initial value of the second voltage output terminal is the high voltage, an initial value of the reference voltage output terminal is the low voltage, and an initial value of the sampling voltage output terminal is the low voltage.

To solve the above technical problem, an embodiment of the present disclosure further provides a display panel comprising the above display drive circuit. The display drive circuit is driven by the above method.

Beneficial Effect

Different from current technology, the present disclosure can effectively prevent the problem of display poorly caused by voltage drift when thin film transistors are used for a long time, thereby extending service life of display drive circuits, and effectively saving resources.

DETAILED DESCRIPTION OF PREFERRED EMBODIMENTS

The embodiments of the present disclosure are described in detail hereinafter. Examples of the described embodiments are given in the accompanying drawings. The specific embodiments described with reference to the attached drawings are all exemplary and are intended to illustrate and interpret the present disclosure. Based on the embodiments in the present disclosure, all other embodiments obtained by those skilled in the art without creative efforts are within the scope of the present disclosure.

Figure 1:
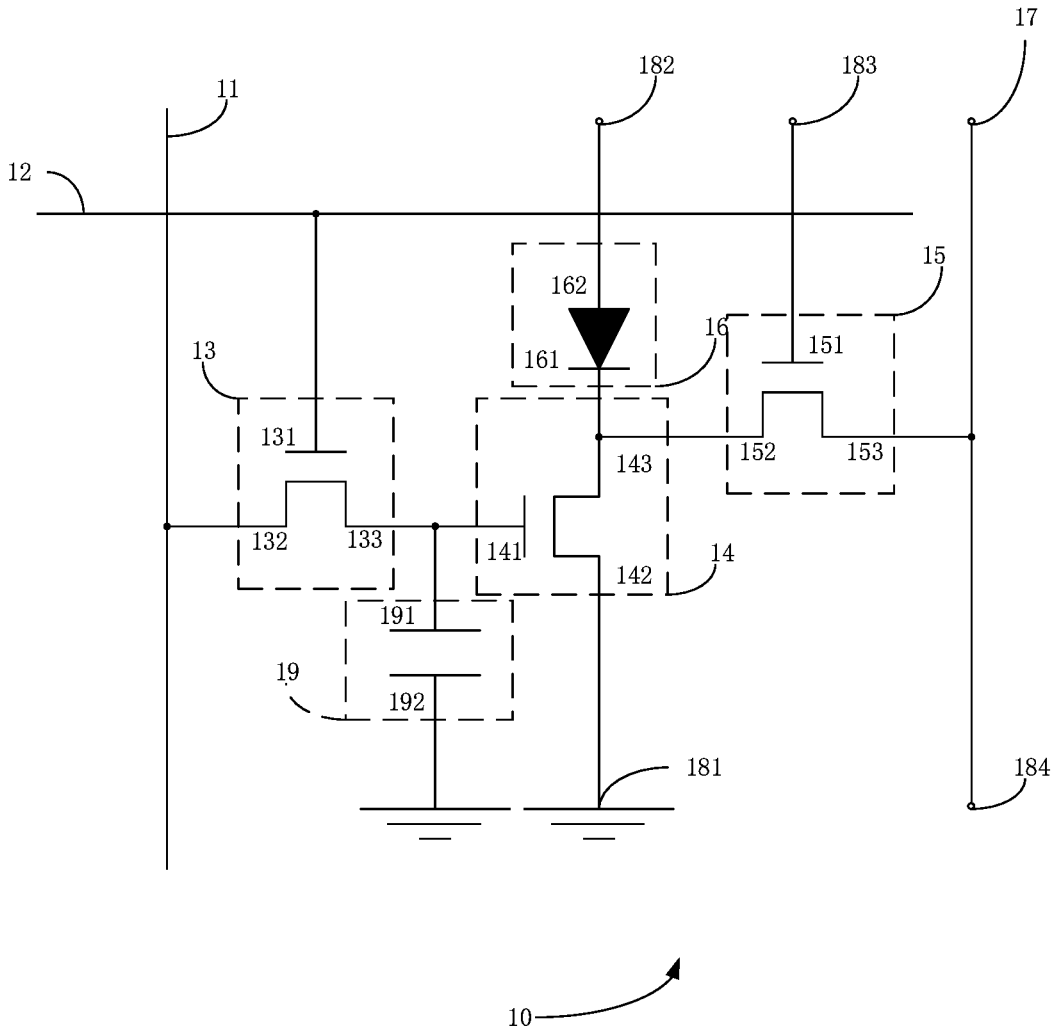
FIG. 1 is a schematic structural diagram of a display drive circuit according to an embodiment of the present disclosure.

Referring to FIG. 1, FIG. 1 is a schematic structural diagram of a display drive circuit according to an embodiment of the present disclosure. A display drive circuit 10 comprises data lines 11, scan lines 12, first thin film transistor 13, second thin film transistor 14, third thin film transistor 15, light-emitting diode 16, and sensor 17.

The data lines 11 and the scan lines 12 are perpendicular to each other and are insulated from each other. The data lines 11 are used to provide a data voltage, and the scan lines 12 are used to provide a scan voltage. A gate electrode 131 of the first thin film transistor 13 is connected to the data lines 11, and a first electrode 132 of the first thin film transistor 13 is connected to the scan lines 12. A gate electrode 141 of the second thin film transistor 14 is connected to a second electrode 133 of the first thin film transistor 13, a first electrode 142 of the second thin film transistor 14 is connected to a first voltage output terminal 181, and a second electrode 143 of the second thin film transistor 14 is connected to a second voltage output terminal 182. A gate electrode 151 of the third thin film transistor 15 is connected to a sampling voltage output terminal 183, a first electrode 152 of the third thin film transistor 15 is connected to the second electrode 143 of the second thin film transistor 14, and a second electrode 153 of the third thin film transistor 15 is connected to a reference voltage output terminal 184. An anode 161 of the light-emitting diode 16 is connected to the second electrode 143 of the second thin film transistor 14, and a cathode 162 is connected to the second voltage output terminal 182. The sensor 17 is connected to the second electrode 153 of the third thin film transistor 15.

Further, referring to FIG. 1, the display drive circuit 10 further comprises a capacitor 19. A first terminal 191 of the capacitor 19 is connected to the first voltage output terminal 181.

In the embodiment, both the first voltage output terminal 181 and the second voltage output terminal 182 can output a high voltage and a low voltage with fixed amplitudes. One of the first voltage output terminal 181 and the second voltage output terminal 182 outputs the high voltage, and the other outputs the low voltage. For example, when the first voltage output terminal 181 outputs the high voltage, the second voltage output terminal 182 outputs the low voltage, and when the first voltage output terminal 181 outputs the low voltage, the second voltage output terminal 182 outputs the high voltage.

Further, in the embodiment, the display drive circuit further includes a control chip (not shown in the figure). The control chip can used to control amplitudes of the voltages output from the first voltage output terminal 181 and the second voltage output terminal 182. That is, the control chip can control the first voltage output terminal 181 and the second voltage output terminal 182 to output the high voltage or the low voltage.

Further, the control chip is connected to the sensor 17 and the data lines 11 to adjust a voltage value of the data voltage provided by the data lines 11 according to a result sensed by the sensor 17.

Figure 2:
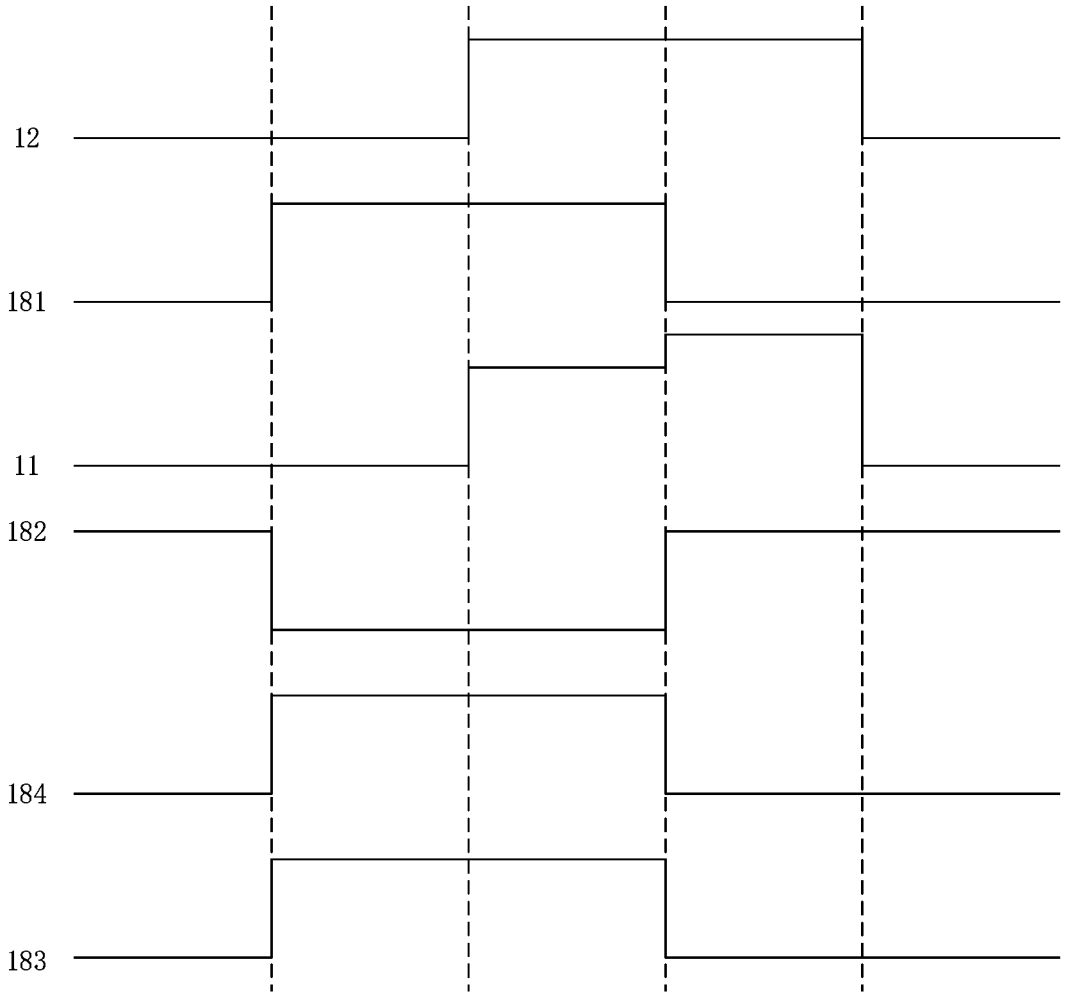
FIG. 2 is a timing diagram of drive voltages of the display drive circuit according to an embodiment of the present disclosure.

Referring to FIG. 2, FIG. 2 is a timing diagram of drive voltages of a display drive circuit according to an embodiment of the present disclosure. When the drive circuit is in an initial state, that is, when voltage drift of the second thin film transistor 15 has not been detected, the scan lines 12 haven't provided the scan voltage, the data lines 11 haven't provided the data voltage, the first voltage output terminal 11 provides the low voltage, the second voltage output terminal provides the high voltage, and the reference voltage output terminal 184 and the sampling voltage output terminal 183 have not provided voltages.

When it starts to detect voltage drift of the second thin film transistor 15, in a first time period, output values of the first voltage output terminal 181 and the second voltage output terminal 182 are inverted. That is, the first voltage output terminal 181 outputs the high voltage, and the second voltage output terminal 182 outputs the low voltage. Meanwhile, the high voltage and the low voltage of the first electrode 142 and the second electrode 143 of the second thin film transistor 14 are inverted, and the high voltage and the low voltage of the anode 161 and the cathode 162 of the light-emitting diode 16 are inverted. The reference voltage output terminal 184 and the sampling voltage output terminal 183 respectively provide a reference voltage and a sampling voltage. Meanwhile, the gate electrode 151 of the third thin film transistor 15 has the sampling voltage, the first electrode 151 has the low voltage, and the second electrode 153 has the reference voltage. When a voltage difference between the sampling voltage and the low voltage is great enough, the third thin film transistor 15 is in a conductive state. Therefore, a voltage of the anode 161 of the light-emitting diode 16 is the reference voltage.

In a second time period, the scan lines 12 provide the scan voltage, the data lines 11 provide the data voltage. Because the first electrode 132 of the first thin film transistor 13 has the data voltage, the gate electrode 131 of the first thin film transistor 13 has the scan voltage, and the second electrode 133 of the first thin film transistor 13 has the low voltage, the first thin film transistor 13 is in a conductive state. The gate electrode 141 of the second thin film transistor 14 has the data voltage, the first electrode 142 of the second thin film transistor 14 has the high voltage, and the second electrode 143 of the second thin film transistor 14 has the low voltage, so the second thin film transistor 14 is in a conductive state.

Meanwhile, a voltage of the first electrode 142 of the second thin film transistor 14 is the high voltage, and a voltage of the anode 161 of the light-emitting diode 16 is the reference voltage. Because the reference voltage is less than a value of the high voltage of the first voltage output terminal 181 minus a drift voltage of the second thin film transistor 14, the first electrode 142 of the second thin film transistor 14 will continuously charge the anode 161 of the light-emitting diode 16 until the voltage has the value of the high voltage of the first voltage output terminal 181 minus the drift voltage of the second thin film transistor 14. The sensor 17 is connected to the anode 161 of the light-emitting diode 16, so it can obtain voltage variations of the anode 161 of the light-emitting diode 16 and send the variations to the control chip. Because the voltage amplitude output from the first voltage output terminal 181 is set by the control chip, the control chip can calculate the drift voltage of the second thin film transistor 14 according to the voltage of the anode 161 of the light-emitting diode 16 and the high voltage output from the first voltage output terminal 181.

In a third time period, because the control chip has calculated the drift voltage of the second thin film transistor 14, the control chip can adjust the data voltage provided by the data lines 11 correspondingly by adding the drift voltage of the second thin film transistor 14 to the initial data voltage as a new data voltage.

Subsequently, when the display drive circuit 10 is working, the data voltage provided by the data lines 11 is the new data voltage, thereby making up for the drift voltage of the second thin film transistor 14, ensuring display quality, extending product life, and avoiding waste of resources.

From the above description, the embodiment of the present disclosure can obtain the drift voltage of the second thin film transistor by detecting the voltage of the anode of the light-emitting diode, and then adding the drift voltage to the initial data voltage provided by the data lines as the new data voltage, thereby effectively preventing the problem of display poorly caused by voltage drift when thin film transistors are used for a long time, extending service life of display drive circuits, and effectively saving resources.

Figure 3:
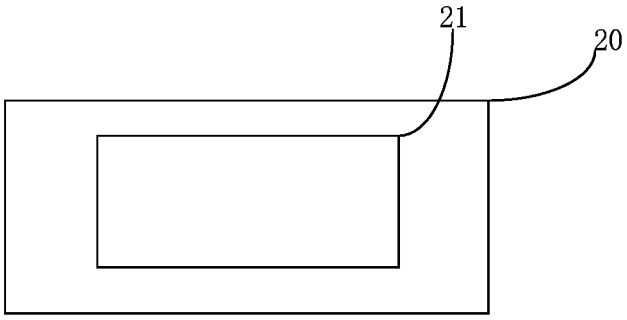
FIG. 3 is a schematic structural diagram of a display panel according to an embodiment of the present disclosure.

Referring to FIG. 3, FIG. 3 is a schematic structural diagram of a display panel according to an embodiment of the present disclosure. A display panel 20 comprises a display drive circuit 21. The display drive circuit 21 is as shown in FIG. 1, and is driven by the time sequence of the drive voltage as shown in FIG. 2.

From the above description, the display panel of the embodiment can obtain the drift voltage of the second thin film transistor by detecting the voltage of the anode of the light-emitting diode, and then adding the drift voltage to the initial data voltage provided by the data lines as the new data voltage, thereby effectively preventing the problem of display poorly caused by voltage drift when thin film transistors are used for a long time, extending service life of display panels, and effectively saving resources.

Different from current technology, the present disclosure can effectively detect a drift voltage of thin film transistors, and adjust correspondingly according to the drift voltage. It can effectively prevent the problem of display poorly caused by voltage drift when thin film transistors are used for a long time, thereby extending service life of display panels, and effectively saving resources.

The present disclosure has been described with a preferred embodiment thereof. The preferred embodiment is not intended to limit the present disclosure, and it is understood that many changes and modifications to the described embodiment can be carried out without departing from the scope and the spirit of the disclosure.

What is claimed is:

1. A method for operating a display drive circuit, wherein the display drive circuit comprises:

a plurality of data lines and scan lines disposed perpendicular to and insulated from each other, wherein the data lines are used to provide a data voltage, and the scan lines are used to provide a scan voltage;

a pixel of the display drive circuit comprises:

a first thin film transistor, wherein a gate electrode of the first thin film transistor is connected to one of the scan lines, and a first electrode of the first thin film transistor is connected to one of the data lines;

a second thin film transistor, wherein a gate electrode of the second thin film transistor is connected to a second electrode of the first thin film transistor, a first electrode of the second thin film transistor is connected to a first voltage output terminal, and a second electrode of the second thin film transistor is connected to a second voltage output terminal;

a third thin film transistor, wherein a gate electrode of the third thin film transistor is connected to a sampling voltage output terminal, a first electrode of the third thin film transistor is connected to the second electrode of the second thin film transistor, and a second electrode of the third thin film transistor is connected to a reference voltage output terminal;

a light-emitting diode, wherein an anode is connected to the second electrode of the second thin film transistor, and a cathode is connected to the second voltage output terminal; and a sensor connected to the second electrode of the third thin film transistor;

the method comprising:

inverting output values of the first voltage output terminal and the second voltage output terminal to make the reference voltage output terminal output a high voltage and the sampling voltage output terminal output a low voltage;

the scan lines providing the scan voltage, the data lines providing the data voltage, and the sensor sensing a voltage variation value of the anode of the light-emitting diode; and adjusting the data voltage provided by the data lines according to the voltage variation value.

2. The method according to claim 1, wherein the step of adjusting the data voltage provided by the data lines according to the voltage variation value comprises:

obtaining an end value of the voltage variation value and calculating a drift voltage of the second thin film transistor; and adding the drift voltage to the data voltage provided by the data lines to be a new data voltage.

3. The method according to claim 2, wherein an initial value of the first voltage output terminal is the low voltage, an initial value of the second voltage output terminal is the high voltage, an initial value of the reference voltage output terminal is the low voltage, and an initial value of the sampling voltage output terminal is the low voltage.

* * * * *